United States Patent [19]

Traver et al.

[11] Patent Number: 4,504,188

[45] Date of Patent: Mar. 12, 1985

[54] PRESSURE VARIATION ABSORBER

[75] Inventors: Darwin G. Traver, DeWitt; Carl M. Anderson, Syracuse, both of N.Y.; Amr N. Abdelhamid, Luzerne, Canada

[73] Assignee: Carrier Corporation, Syracuse, N.Y.

[21] Appl. No.: 518,992

[22] Filed: Aug. 1, 1983

Related U.S. Application Data

[60] Division of Ser. No. 14,525, Feb. 23, 1979, Pat. No. 4,411,592, which is a continuation of Ser. No. 815,330, Jul. 13, 1977, abandoned.

[51] Int. Cl.[3] ..... F04D 29/66

[52] U.S. Cl. ..... 415/1; 415/119; 415/219 A; 415/DIG. 1

[58] Field of Search ..... 415/DIG. 1, 144, 119, 415/219 R, 211, 219 A, 1; 181/222, 224, 225, 230, 286, 292, 293

[56] References Cited

U.S. PATENT DOCUMENTS

| | | | |
|---|---|---|---|
| 2,225,398 | 12/1940 | Hamblin | 415/119 |
| 2,285,976 | 6/1942 | Huitson | 415/219 A |
| 2,434,682 | 1/1948 | Zahn | 415/219 A |
| 2,656,096 | 10/1953 | Schwarz | 415/DIG. 1 |
| 2,925,952 | 2/1960 | Garve | 415/219 A |
| 3,286,914 | 11/1966 | Baverstock | 415/119 |
| 3,289,921 | 12/1966 | Soo | 415/219 A |
| 3,362,629 | 1/1968 | Papapanu | 415/144 UX |
| 3,540,547 | 11/1970 | Coward, Jr. | 181/225 |
| 3,901,620 | 8/1975 | Boyce | 415/DIG. 1 |
| 4,174,020 | 11/1979 | Challis | 181/222 X |

OTHER PUBLICATIONS

Air and Gas Engineering, vol. 1, No. 1, Jan. 1968, "Centrifugal Compressors . . . The Cause of the Curve".

*Primary Examiner*—Robert E. Garrett
*Assistant Examiner*—Joseph M. Pitko
*Attorney, Agent, or Firm*—David J. Zobkiw

[57] ABSTRACT

Pressure variation absorbing apparatus is mounted adjacent to a moving fluid stream in the diffuser of a centrifugal compressor for absorbing both acoustic and aerodynamic pressure variations. The absorbing apparatus when mounted as a part of the diffuser wall of a centrifugal compressor not only reduces acoustic noise but also absorbs aerodynamic pressure variations increasing the efficiency of the compressor and simultaneously reducing the rate of flow at which surge occurs thereby enlarging the operational flow range of the compressor. A method of absorbing pressure variations in a moving fluid stream is also disclosed.

3 Claims, 5 Drawing Figures

PRESSURE VARIATION ABSORBER

This application is a division of application Ser. No. 14,525, filed 2/23/79, now U.S. Pat. No. 4,411,592, which is a continuation application of Ser. No. 815,330 filed 7/13/77, now abandoned.

BACKGROUND OF THE INVENTION

This invention relates to the field of absorbing acoustic, aerodynamic and the combination of acoustic and aerodynamic pressure variations or fluctuations from a fluid stream. More particularly for absorbing acoustic, aerodynamic and the combination of acoustic and aerodynamic pressure waves from the compressible fluid passing through a diffuser in a centrifugal compressor or other similar machine.

DESCRIPTION OF THE PRIOR ART

Centrifugal compressors are utilized by the refrigeration industry in most large installations where a single large refrigeration machine is used to provide cooling, heating or both. Many methods have been attempted with varying degrees of success to limit the level of loudness of the audible noise emitted by a centrifugal refrigeration machine. These methods have included encasing the motor and compressor (U.S. Pat. No. 3,635,579); providing sound absorptive material at the inlet and outlet chambers of the compressor (U.S. Pat. No. 3,360,193); locating a baffle in the crossover pipe of a multi-stage compressor (U.S. Pat. No. 3,676,012) and providing an annular muffler in the discharge line of the compressor.

Since large refrigeration installations consume high amounts of electrical energy every effort is made to increase the efficiency of the refrigeration machine to decrease the operating costs of the installation. The absorptive apparatus herein claimed is utilized to obtain an overall efficiency increase in a refrigeration system having a centrifugal compressor.

The operational flow range of a centrifugal compressor is normally limited by the minimal flow volume which can be produced without the occurrence of surge. It is impractical to operate in surge due to pressure pulsations, dynamic and potentially dangerous thrust load variations and increased gas temperatures. When it is desirable to operate a centrifugal compressor under partial load it is necessary to operate the machine at sufficient flow volume to exceed the flow volume at surge notwithstanding that the partial load requirements could be met with a lesser flow rate. When operating at a flow rate which is higher than necessary to meet the load requirements, operating costs increase since the efficiency of the overall system is decreased. Even as surge is approached, aerodynamic instabilities arise introducing losses and lowering efficiency, so that operating costs increase as the surge line is approached. Hence, by decreasing the flow volume at which surge occurs the compressor can operate over a broader flow volume range and operate with a higher efficiency at flow ranges below the previously established surge volume.

Prior efforts to control the volume flow rate at which surge occurs have focused on the diffuser geometry and on providing vanes within the diffuser to control the flow path of the fluid leaving the impeller. See "Centrifugal Compressors . . . the Cause of the Curve" by Donald C. Hallock from *Air and Gas Engineering,* Volume 1, Number 1, January 1968.

SUMMARY OF THE INVENTION

It is an object of the present invnetion to reduce the level of noise emitted from a centrifugal compressor.

It is a further object of the present invention to increase the efficiency of a centrifugal compressor and to increase the operational range of a centrifugal compressor by lowering the flow volume at which surge occurs.

It is a further object of the present invention to reduce the level of the noise emitted from a moving fluid stream.

It is another object of the present invention to reduce the noise level, increase the overall efficiency, and to increase the operational range and pressure rise of a centrifugal compressor without unduly impeding fluid flow or creating severe boundary layer distortions within the fluid flow path.

It is yet another object of the present invention to provide absorbing apparatus which is adaptable to existing centrifugal compressors with a minimum of structural alterations.

It is still a further object of the present invention to absorb both acoustic and aerodynamic pressure variations within the fluid in communication with the absorbing apparatus.

It is also an object of the invention to prevent or delay back pressure and reverse fluid flow by means of acoustical and pressure absorbing material located in the difffuser of a centrifugal compressor.

Other objects will be apparent from the description to follow and the appended claims.

The above objects are achieved according to a preferred embodiment of the invention by the provision of absorbing apparatus in communication with the fluid being compressed in the diffuser section of a compressor. A porous absorbing material is mounted to form a portion of the wall surface of the diffuser. A resonant cavity is located on the opposite side of the absorbing material from the fluid in such a manner that the fluid may flow through the absorbing material into the cavity. The absorbing apparatus is annular in shape and the cavity is divided by concentric rings into a plurality of smaller cavities or by a single helical divider with periodic dams into a narrow elongated cavity or by a honeycomb or similar divider into a multiplicity of cellular type cavities. Damping material such as fiberglass is inserted into the cavity to further aid in absorbing and damping pressure variations. The absorbing material is selected to have a flow resistance approximating the density of the fluid times the speed of sound in the fluid through the diffuser.

DESCRIPTION OF THE PREFERRED EMBODIMENT

The following is a description of absorbing apparatus mounted in communication with the fluid in a compressor to form a portion of the diffuser wall of the diffuser within a centrifugal compressor and of a method of absorbing pressure waves within the fluid. It is to be understood that the invention has like applicability to any moving fluid stream whether it be in a centrifugal compressor, gas turbine or other dynamic head device, which converts increased dynamic head pressure created by moving blades or the like into increased static pressure. Furthermore it would be but a design expedient dependent on the design and operating characteristics of the compressor to select which wall of the diffuser or more than one wall of the diffuser upon which to mount this apparatus. If more than one wall is selected then the diffuser on each could be arranged to absorb different frequency pressure waves. A multistage compressor could likewise utilize the present invention in one or more of the various compression stages.

It is to be further understood that the description herein will refer to a refrigerant as the fluid being compressed in a centrifugal compressor which is part of an overall refrigeration machine. However, it is to be understood that the present invention will have like applicability to any compressible fluid be it a refrigerant, a gas or any other fluid. Since optimum porosity of the absorbing material is a function of the gas or fluid properties, different gases or fluids will require absorbing material of varying porosity to achieve optimum results.

Figure 1:
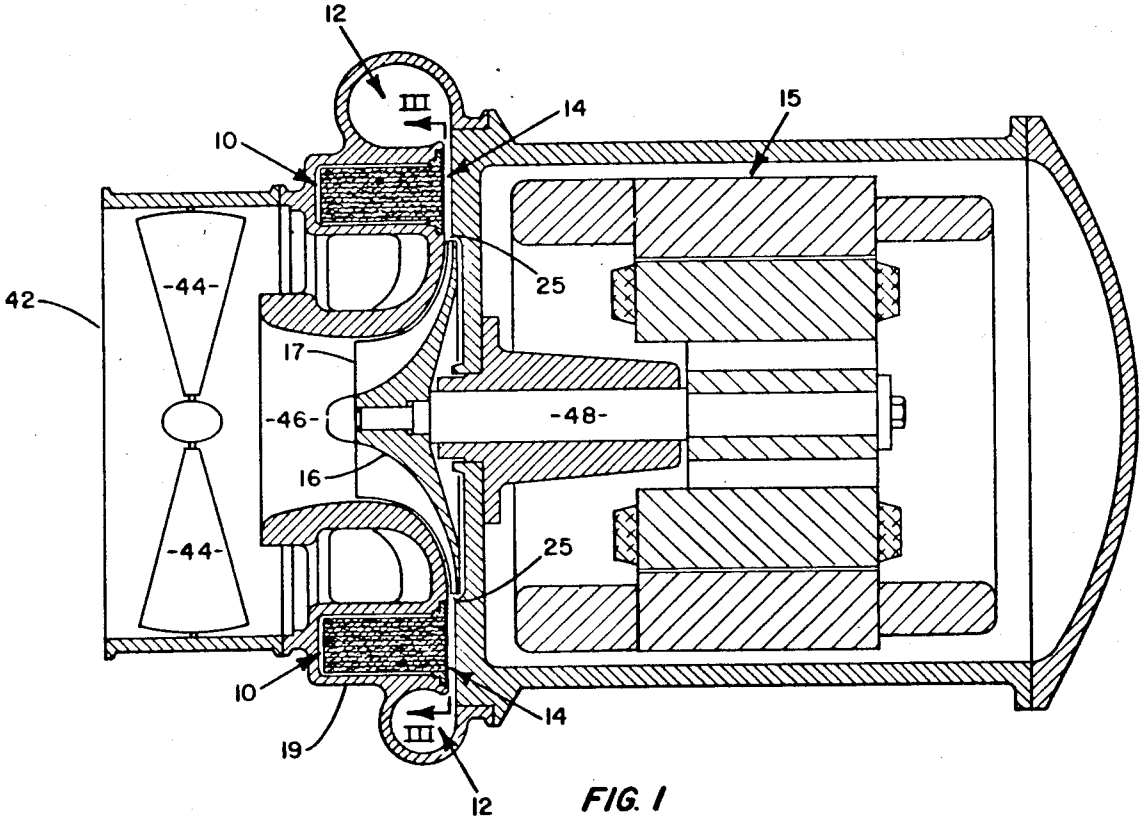
FIG. 1 is a cross-sectional view of a centrifugal compressor having the present invention contained therein.

Referring now to the drawings, it can be seen in FIG. 1 that in a typical centrifugal compressor refrigerant enters the compressor through refrigerant inlet 42 then travels along a refrigerant flow path through the control vanes 44 and into impeller chamber 46. Impeller 16 mounted on shaft 48 and driven by motor 15 then accelerates the refrigerant and discharges the refrigerant into diffuser 14. At the point of discharge, 25, from impeller blades 17, the refrigerant is traveling at a relatively high velocity and is at a relatively low static pressure. The refrigerant then travels through diffuser 14 to collector 12 from which it is discharged into the remainder of the refrigeration machine. The refrigerant leaving the diffuser and entering the collector is traveling at a relatively slow velocity as compared to when it entered the diffuser and is at a relatively high static pressure as compared to the pressure when it entered the diffuser. A pressure variation absorber 10, comprising absorbing material 20 and resonant cavity 13, is in communication with the refrigerant passing through diffuser 14. Volute casting 19 is shown in FIG. 1 as structurally connecting the collector, the diffuser and the impeller chamber.

Figure 2:
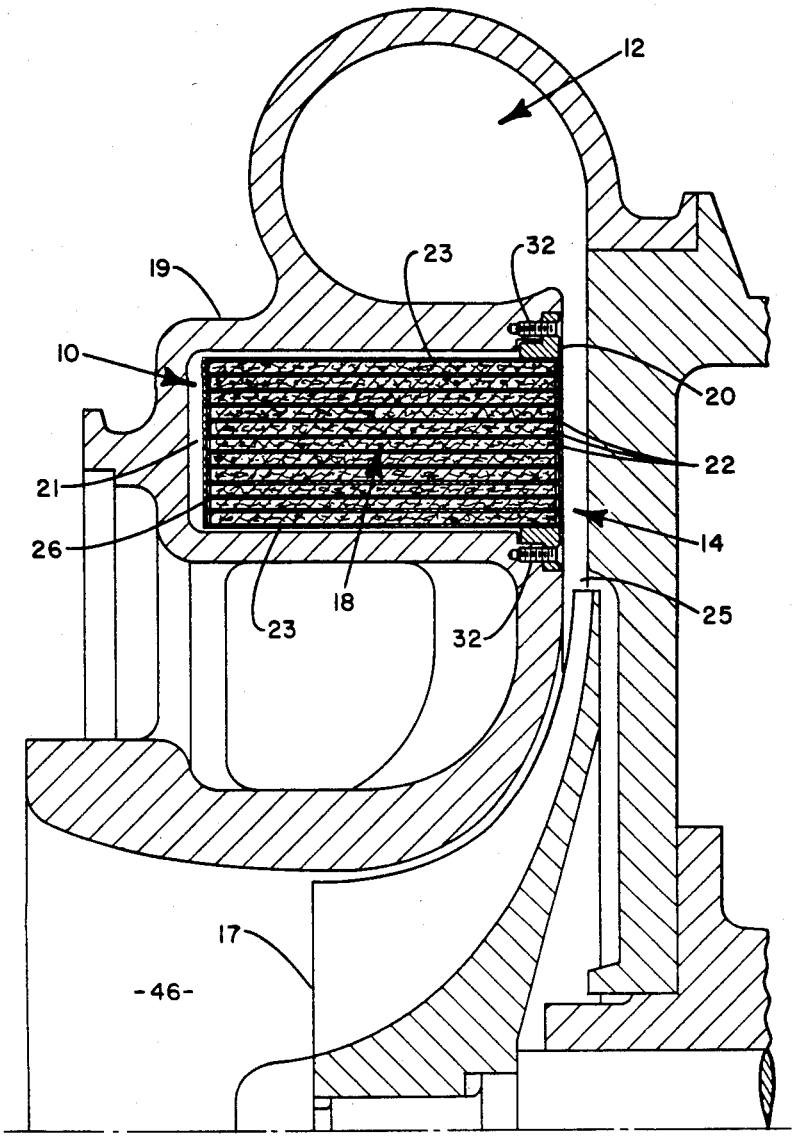
FIG. 2 is an enlarged partial sectional view of the invention mounted to a portion of the diffuser wall of a centrifugal compressor.
Figure 3:
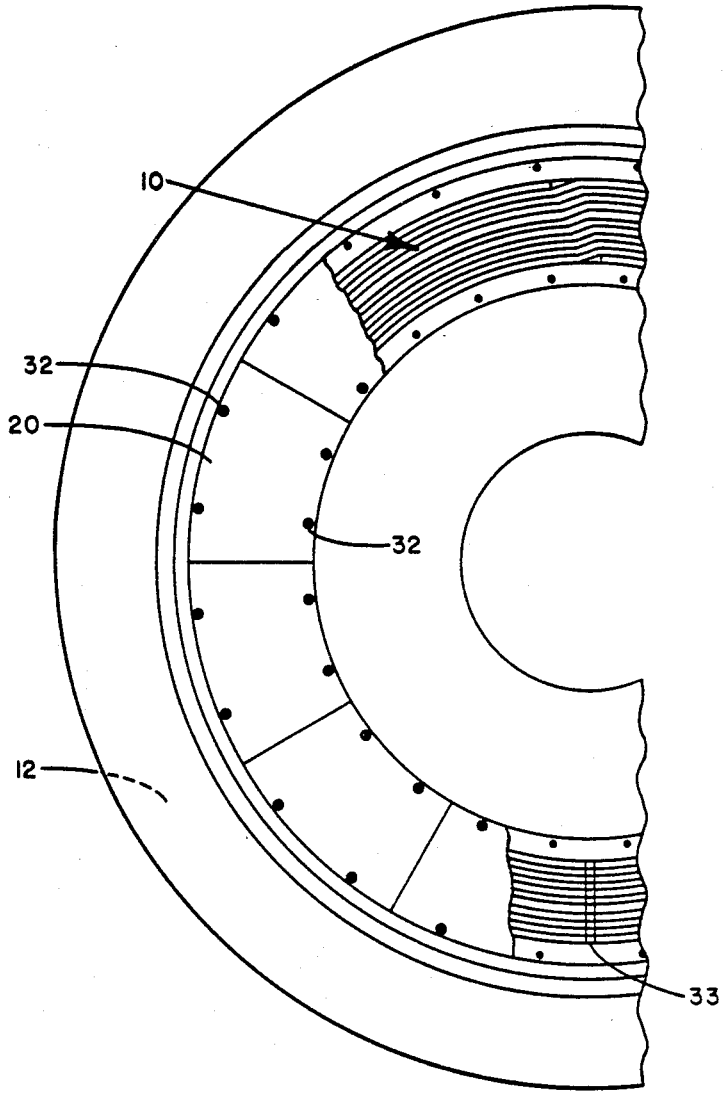
FIG. 3 is a partial elevational end view taken along line 3—3 of FIG. 1 of the invention in a centrifugal compressor showing the cavity divided into a narrow elongated cavity by a single helical divider and showing the location of the absorbing material.

Referring now to FIG. 2 which is a partial enlarged sectional view of the diffuser and the pressure variation absorber, it can be seen that absorbing material 20, a porous high flow resistance sheet of material, is mounted to form a portion of the surface of the diffuser wall. The absorbing material could likewise be mounted on the other diffuser wall or on both walls. The absorbing material is mounted by means of screws 32 and by an adhesive (not shown) to a portion of volute casting 19. On the opposite side of the absorbing material from the fluid is resonant cavity 18 defined by end dividers 23 and a backplate 26. As can be seen from FIG. 3 pressure variation absorber 10 is annular in shape and each end divider forms a complete ring so that resonant cavity 18 formed by the two end dividers, backplate 26 and the absorbing material 20 is annular in configuration although other configurations would be equally acceptable. It can be further seen in FIG. 2 that the annular resonant cavity is divided into a series of smaller cavities by dividers 22. Dividers 22 may be a single helix with periodic solid flow barriers 33 as shown in FIG. 3 or comprise a series of concentric rings. A honeycomb or cellular type divider would also be satisfactory. No matter what the divider configuration a narrow cavity or series of cavities is provided. The pressure variation absorber is shown mounted within volute cavity 21 formed by various portions of volute 19. This particular arrangement is structural and has no effect on the claimed invention.

If a narrow plurality of cavities were not provided the refrigerant flowing through the diffuser having a relatively low static pressure at the end of the absorber closest to the impeller and a relatively high static pressure at the end of the absorber closest to the collector would enter the pressure variation absorber closest to the collector and flow backwards towards the end of the pressure variation absorber closest to the impeller. This backward flow of refrigerant would then detract from the overall efficiency of the unit. By providing a single helical resonant cavity with periodic flow barriers back flow due to the pressure gradient is sufficiently small relative to the high flow resistance of the absorbing material that overall machine efficiency is not substantially affected. Back flow can similarly be limited by concentric dividers or a multiplicity of cellular type cavities so that the incremental pressure drop in each cavity is minimal.

It can be further seen that end dividers 23 and dividers 22 are sealed to prevent fluid flow between the separate cavities. Dividers 22 and end dividers 23 are mounted to absorbing material 20 and to backplate 26 by means of an epoxy type resin. The resonant cavity 18 of the pressure variation absorber is further filled with a damping material such as fiberglass to increase the absorbing efficiency of the unit and to provide damping of possible resonating pressure waves within cavity 18.

Figure 4:
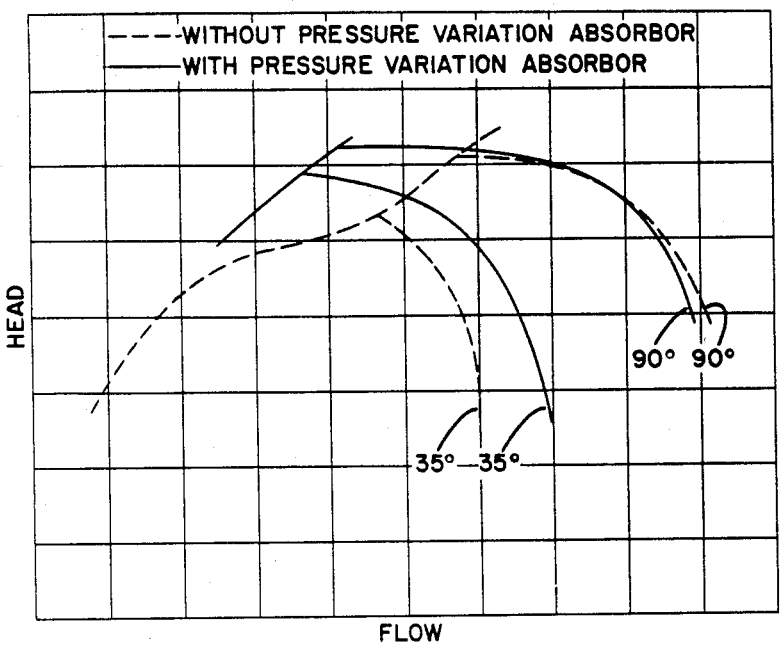
FIG. 4 is a graph of exit pressure from a centrifugal compressor versus exit volume from a centrifugal compressor shown with and without the claimed pressure variation absorber herein and with the inlet vane angle of the compressor control vanes set at both 35 degrees and at 90 degrees.

FIG. 4 is an experimentally developed graph of head pressure versus flow volume for a centrifugal compressor equipped with and without the herein described invention. The graph shows both operation of the compressor with the pressure variation absorber and without the pressure variation absorber. The dotted line, when the machine is operated without the pressure variation absorber, shows that surge occurs at a much higher flow volume then with the present apparatus. Furthermore, the graph shows the respective characteristics with the control vanes set at a 35 degree angle and with the control vanes set at a 90 degree angle. It can be seen from the graph that the operational range between the point when surge occurs and when head pressure is reduced below an operational value is greatly increased, especially at the lower flow volumes. In addition, the pressure rise of the compressor is increased particularly for control vane settings below 90 degrees.

The method of utilizing this apparatus includes locating the pressure variation absorber within the diffuser so that pressure variations in the fluid within the diffuser are absorbed. These variations include acoustical and aerodynamic waves generated by the impeller as the fluid is accelerated and those waves occurring as a result of surge and other aerodynamic instabilities such as rotational stall as the fluid is pressurized and decelerated in the diffuser.

The precise mechanism which operates to improve the efficiency of the machine and to reduce the flow volume at which surge occurs is not fully known. It has been discovered that an absorber designed to absorb acoustic waves (which are pressure variations) and thereby reduce noise emitted by the machine also acts to absorb aerodynamic pressure variations which result from surge and other aerodynamic instabilities affecting the overall efficiency of the machine. It is theorized that an absorber acts to restrict pressure variations resulting from either acoustic waves or aerodynamic instabilities. The efficiency improvement results from the elimination or reduction in severity of the aerodynamic instabilities. A smooth flow without pressure variations not only results in a machine having a lower flow rate at which surge may occur and thereby having a greater operational range but also adds to the overall efficiency of the unit since the impeller is not forced to overcome these aerodynamic pressure fluctuations that the absorber is removing them from the system.

Ramdom and periodic aerodynamic pressure variations of unknown origin have also been detected within a centrifugal compressor. It is experimentally determined that the disclosed absorber also attenuates these variations further adding to the efficiency of the overall machine.

The absorbing material 20, such as "Feltmetal" or "Fibermetal" manufactured by Brunswick Corporation of Muskegon, Mich. or "Rigimesh" manufactured by Aircraft Porous media, Glen Cove, N.Y., is selected so that its flow resistance approximates the density of the fluid times the speed of sound in the fluid across the absorbing material. Hence, the absorbing material is varied according to the fluid being used or more particularly according to the particular refrigerant selected for the particular application. The table below shows various refrigerants, the various densities of the refrigerant leaving the impeller, the various velocities of the speed of sound in the refrigerant and the consequent optimum flow resistance the absorbing material should have for each application. (A conversion factor of 0.48823 is used to convert from English to Metric units.)

| Refrigerant | Density Lbs/Ft | Speed of Sound Ft/Sec | Flow Resistance Rayls (cgs) |
|---|---|---|---|
| Air | 0.075 | 1100 | 40.3 |
| R-11 | 0.55 | 500 | 134.3 |
| R-114 | 1.40 | 400 | 273.4 |
| R-12 | 3.00 | 500 | 732.4 |
| R-500 | 3.00 | 500 | 732.4 |
| R-22 | 3.50 | 550 | 939.8 |

Figure 5:
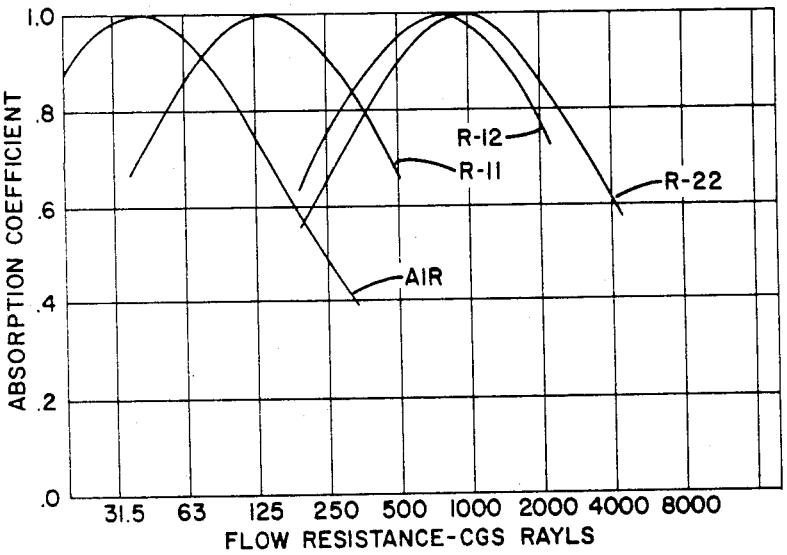
FIG. 5 is a graph of flow resistance versus absorption coefficient for air, R-11, R-12 and R-22.

FIG. 5 is a graph of the maximum normal absorption coefficient versus flow resistance for Air, R-11, R-12 and R-22 as measured in an acoustic impedance tube. This graph is a plot of values which shows that an absorption coefficient of approximately 1.0 is obtainable by selecting the proper flow resistance for the absorbing material. The graph confirms that material having the values set forth in the table is the optimum choice to absorb pressure variations for the particular refrigerant.

The resonant cavity backing the absorbing material is designed so that its depth is one quarter the wave length of the wave length of the lowest frequency of sound that it is desired to absorb. For example, if R-11 (trichloro-fluoromethane) is the refrigerant being used in the machine and the pressure variation absorber is designed to eliminate acoustical noise at 300 hertz and above, then the cavity depth should be 5 inches; the velocity of the speed of sound of R-11 divided by four times the frequency.

Damping material is selected for the resonant cavity so that all frequencies greater than the frequency for which the cavity is designed will be absorbed or attenuated. The damping material helps to absorb the frequencies between the resonance peaks of the design frequency thereby providing an absorber which will absorb all frequencies from the minimun frequency increasing to the highest audible frequencies and beyond.

It can be seen from the above described embodiment that there has been provided an acoustic and aerodynamic pressure variation absorber which has the capability of not only absorbing acoustic waves and thereby reducing the noise level emitted by the machine and/or the fluid passing there-through but also to absorb aerodynamic pressure variations so that the efficiency of the machine is increased and the overall operational range of the machine is broadened.

The invention has been described in detail with particular reference to the preferred embodiment thereof, but it will be understood that variations and modifications can be effected within the spirit and the scope of the invention.

We claim:

1. A method of operating a centrifugal compressor having an impeller, a diffuser and a collector, comprising the steps of:

accelerating a compressible fluid with the impeller;

converting the compressible fluid velocity pressure to static pressure within the diffuser;

collecting the compressible fluid discharged from the diffuser within the collector at a relatively high static pressure; and absorbing acoustic and aerodynamic pressure variations of the compressible fluid within the diffuser with a resonant cavity located behind a porous absorbing material which forms a portion of a side wall of the diffuser, said porous absorbing material having a flow resistance approximately equal to the density of the compressible fluid multiplied by the speed of sound in the compressible fluid.

2. A method of operating a centrifugal compressor having an impeller, a diffuser and a collector, as recited in claim 1 further comprising the step of:

limiting back flow of the compressible fluid from a relatively high pressure region of the diffuser through the porous absorbing material and through the resonant cavity to a relatively low pressure region of the diffuser by dividing the resonant cavity into a series of smaller cavities which are each in fluid communication with the fluid in the diffuser through the porous absorbing material so that each cavity is at a different pressure level depending on its distance along the side wall of the diffuser from the impeller.

3. A method of operating a centrifugal compressor having an impeller, a diffuser and a collector, comprising the steps of:

accelerating a compressible fluid with the impeller;

converting the compressible fluid velocity pressure to static pressure within the diffuser;

collecting the compressible fluid discharged from the diffuser within the collector at a relatively high static pressure;

absorbing acoustic and aerodynamic pressure variations of the compressible fluid within the diffuser with a resonant cavity located behind a porous absorbing material which forms a portion of a side wall of the diffuser; and further absorbing acoustic and aerodynamic pressure variations of the compressible fluid within the diffuser with a damping material which fills at least a portion of the resonant cavity.

* * * * *